US006170741B1

(12) United States Patent
Skolik et al.

(10) Patent No.: US 6,170,741 B1
(45) Date of Patent: Jan. 9, 2001

(54) CONTAINER CARRIER

(75) Inventors: Bernhard Skolik, Bassum; Jens Eckermann; Hilger Scheelcke, both of Bremen, all of (DE)

(73) Assignee: FCP Europa Carton Faltschachtel GmbH, Hamburg (DE)

( * ) Notice: Under 35 U.S.C. 154(b), the term of this patent shall be extended for 0 days.

(21) Appl. No.: 09/387,425

(22) Filed: Aug. 31, 1999

(30) Foreign Application Priority Data

Sep. 1, 1998 (DE) ..... 298 15 677

(51) Int. Cl.[7] ..... B65D 5/468
(52) U.S. Cl. ..... 229/117.13; 229/199; 206/427
(58) Field of Search ..... 229/117.12, 117.13, 229/103.2, 199; 206/141, 427

(56) References Cited

U.S. PATENT DOCUMENTS

| | | | | |
|---|---|---|---|---|
| 3,266,708 | * | 8/1966 | Ellis | 229/199 |
| 4,128,169 | | 12/1978 | Arneson | 206/141 |
| 4,155,449 | * | 5/1979 | Bryne | 206/427 |
| 5,167,325 | | 12/1992 | Sykora | 206/143 |
| 5,234,102 | | 8/1993 | Schuster et al. | 206/141 |
| 5,495,943 | * | 3/1996 | Bienaime | 206/427 |
| 5,826,782 | * | 10/1998 | Stout | 229/117.13 |
| 5,873,516 | * | 2/1999 | Boggs | 229/117.13 |

FOREIGN PATENT DOCUMENTS

| | | |
|---|---|---|
| 2551007 | 10/1985 | (DE) . |
| 83 37 960 | 5/1987 | (DE) . |
| 296 13814 | 12/1996 | (DE) . |
| 0630826 | 6/1994 | (EP) . |
| 86/05463 | 12/1986 | (WO) . |

* cited by examiner

*Primary Examiner*—Gary E. Elkins
(74) *Attorney, Agent, or Firm*—Vidas, Arrett & Steinkraus, P.A.

(57) ABSTRACT

A container carrier including a blank of a foldable sheet material, in particular cardboard, for wrapping around a plurality of bottles or other containers which includes a bottom panel, side panels hingedly joined to the longitudinal edges of the bottom panel, and a top panel hingedly joined to other longitudinal edges of the side panels. Two spaced-apart handle openings are included in the top panel. The container carrier also includes a connection between one of the aforementioned panels and an adhesive tab hingedly attached to an adjacent panel or between overlapping sections of one of these panels. A further blank made of a foldable sheet material, in particular cardboard, is arranged above the plurality of containers which comprises a reinforcement panel provided under the top panel. Two further spaced-apart handle openings are included in the reinforcement panel arranged under the handle openings of the top panel and a connection to the blank to be wrapped around the containers.

21 Claims, 4 Drawing Sheets

CONTAINER CARRIER

BACKGROUND OF THE INVENTION

The invention relates to a container carrier comprising a blank made of a foldable sheet material, in particular cardboard, for wrapping around a plurality of containers, in particular bottles.

From the DE-C2-25 51 007 a wraparound carrier for bottles is known which comprises side panels hingedly-joined to a bottom panel and top panel portions hingedly joined to said side panels. The top panel portions are adhesively bonded together so as to overlap for closing the wraparound carrier and reinforcing a handle area between two handle openings in the top panel portions. For a further reinforcement the inner top panel portion besides comprises a handle reinforcing tab which is bonded to its outer surface. Said outer surface in turn is adhesively secured to the outer top panel portion, so that a handle area of triple ply thickness is formed. Such bottle carriers can already be preglued by the manufacturer of collapsible packing cartons so as to form a wrap and can be supplied with said wraps being arranged in the flat one upon the other. The bottle carriers will be unfolded by the packer then and be filled through a front end opening. Finally, they are closed by the packer by moving front end tabs within front end openings and adhesively bonding said front end tabs to one another.

The carrier of containers consists of a one-piece blank of a kraftboard which is made of a coated material because of the usual imprinting on the outer surface. Thus, it is based on a relatively expensive cardboard material.

Taking this into consideration, it is the object of the present invention to provide a container carrier of the type described at the beginning which has the necessary strength in the area surrounding the handle but is more cost-effective.

SUMMARY OF THE INVENTION

The container carrier according to the invention comprises a blank made of a foldable sheet material which, in particular, may consist of cardboard, for wrapping around a plurality of bottles or other containers (e.g. cans or glasses). This blank includes a bottom panel, side panels hingedly joined to the longitudinal edges of the bottom panel and a top panel hingedly joined to other longitudinal edges of the side panels and bridging the latter. In the top panel two spaced-apart handle openings are provided. Finally, the blank comprises a connection between one of the aforementioned panels and an adhesive tab hingedly attached to an adjacent panel. This connection may also be formed between overlapping sections of one of these panels instead. By means of said connection the blank is closed so as to form a wrap.

In addition, the container carrier comprises a further blank made of a foldable sheet material to be arranged above the plurality of containers which, in particular, may consist of cardboard. This blank includes a reinforcement panel arranged under the top panel. This reinforcement panel is provided with two further spaced-apart handle openings arranged under the handle openings of the top panel. Besides, said further blank comprises a connection to the blank to be wrapped around the containers.

The blank to be wrapped around the containers may be produced by printing sheets of cardboard and subsequent die-cutting. For this purpose, preferably, a kraft (card)board, particularly a coated cardboard material, is used. The second blank may be produced by merely die-cutting sheets of cardboard. Preferably, this may be a recycled cardboard, particularly an uncoated cardboard material.

The two blanks are positioned to one another and connected to one another, particularly by bonding which, preferably, is done by the manufacturer of collapsible packing cartons. Preferably, the manufacturer can also take care of the folding required for closing the wraparound carrier, as well as of the connection, for which a glueing is preferred as well. There may be used the same machine for connecting the two blanks and closing the wraparound carrier. The carriers prepared in such a way can be transported to the packer while being arranged in stacks flat one upon the other.

The packer then only needs to unfold the carrier and insert a plurality of containers through a front end opening. Preferably, the carrier comprises front end panels, by means of which the front end openings are closed then. The afore-mentioned operation, in particular, may be carried out by the packer with the aid of any machines universally to be used for premanufactured wraparound carriers for containers. Those machines may be constructed in a substantially simpler way than wrapping machines which are used for wraparound carriers, as they are known from EP 0 630 826 A1, for instance. Thus, this container carrier facilitates a simplified packing procedure. This, however, must not be necessarily carried out in the way described before. In particular, there is a possibility that only the packer takes care ofjoining together the blanks and preparing the wraparound carrier.

The finished container carrier ensures the necessary strength in the handle area and stability in the whole upper area which prevents the cardboard material from tearing in the area of the handle openings during transport in consequence of the weight of the containers. There may be used any kraftboard for the blank and the other blank and each kraftboard may have a lighter grammage than a kraftboard of a one-piece blank which fact helps to achieve a reduction of overall costs. However, it is of particular advantage that there is no necessity to make use of a kraftboard for the other blank but that there may be used a sheet material of inferior quality, e.g. a recycling cardboard, even if being uncoated. For the blank to be wrapped around the containers, on the other hand, a sheet material is sufficient which is of substantially lower strength than that for any known carriers which, typically, are made of a one-piece blank of a kraftboard having a grammage (basis weight) of 515 g/m$^2$. So, for example, this blank may be used for a kraftboard having a grammage of about 295 g/m$^2$ if for the other blank an uncoated recycled material is employed. In this way, the overall costs of the container carrier can be substantially reduced.

It is of particular advantage for the strength in the handle area and the dimensional stability in the upper area of the carrier if the other blank comprises longitudinal straps hingedly joined to the longitudinal edges of the reinforcement panel and/or transverse straps hingedly joined to the transverse edges thereof, especially if the longitudinal straps and/or the transverse straps are connected to adjacent side panels and/or front end panels of the blank which, in particular, may be done by glueing. This facilitates a power transfer from the top panel to the side panels and/or front end panels which is to the benefit of the strength and stability.

Any tests, in which the filled carrier of containers is held in the handle area and is subjected to quick up-and-down movements ("drop-jerk-test"), have shown that the carrier according to the invention does not tear and has no unintentional deformations. Accordingly, the carrier according to the invention makes an upward bulging in the handle area possible which is desirable for reaching under the handle openings above the container. It also may be stabilized by the diagonal fold lines which extend from outer areas of the handle openings to the adjacent edges of the top panel, respectively. The forces can preferably be led into the edge areas along these fold lines.

Preferably, the container carrier comprises weakening lines extending from the handle openings into the side panels through the top panel, with tear tabs being defined—preferably on both sides of the carrier—between the handle openings and the weakening lines. After tearing out the tear tabs the containers arranged in the carrier are ready for removal. In contrast to any conventional packages which in the areas concerned comprise several plies of kraftboard of the same strength, another blank made of a material of lower strength facilitates opening of the package by means of the tear tabs.

BRIEF DESCRIPTION OF THE FIGURES

The present invention will now be described with reference to the accompanying drawings of a preferred embodiment, in which.

DETAILED DESCRIPTION OF THE INVENTION

Figure 1:
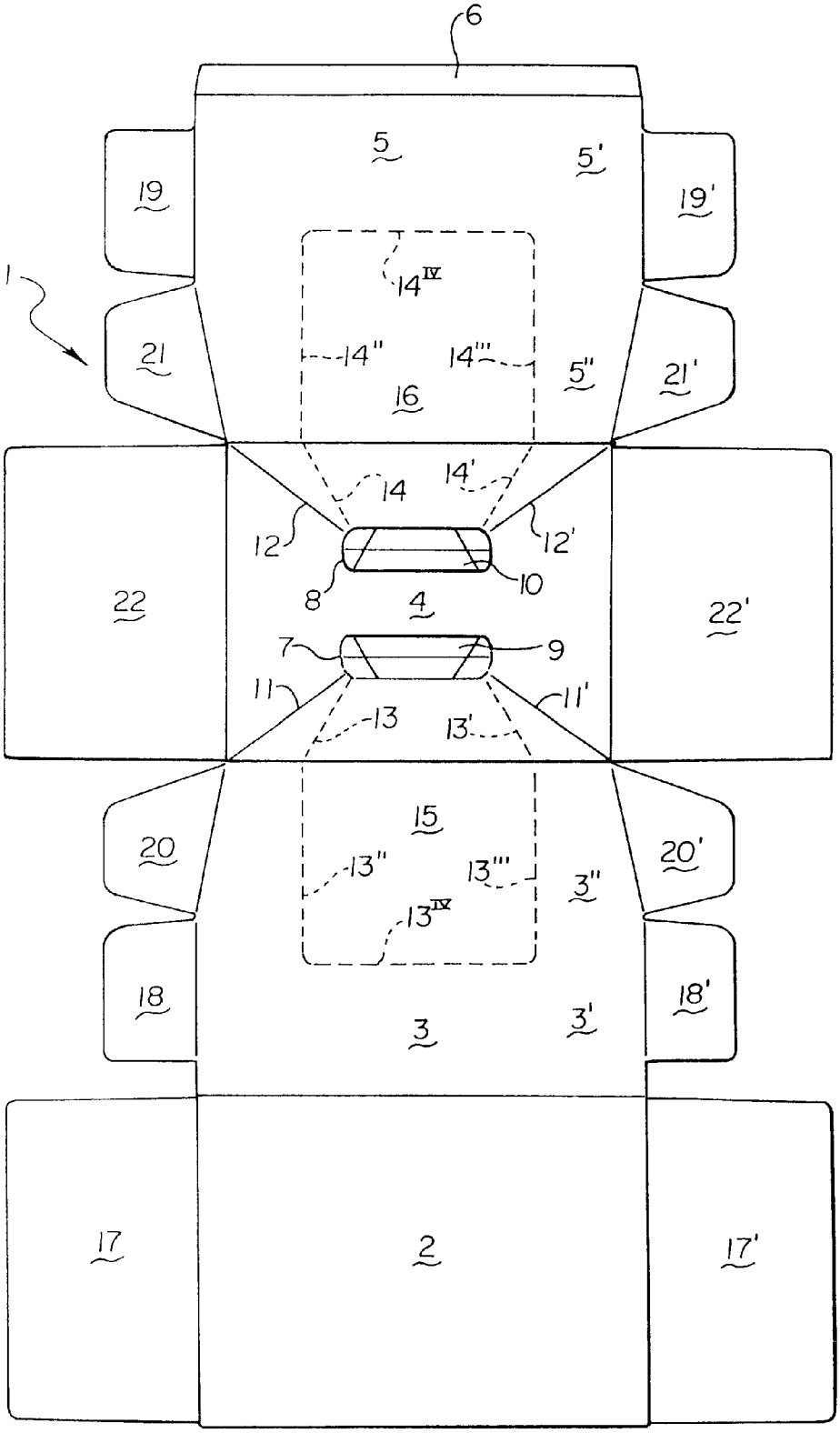
FIG. 1 is a plan bottom view of the blank for wrapping around a plurality of bottles.

The blank 1 illustrated in FIG. 1 comprises a bottom panel 2, a side panel 3 hingedly joined to a longitudinal edge of the bottom panel 2, a top panel 4 hingedly joined to another longitudinal edge of the side panel 3, a side panel 5 hingedly joined to another longitudinal edge of the top panel 4 and an adhesive tab 6 hingedly joined to another longitudinal edge of the side panel 5.

The bottom panel 2 and the top panel 4 are rectangular, with the top panel 4 having a slightly smaller linear extension than the bottom panel 2. The side panels 3, 5 each include one lower side panel section 3', 5' in the form of a rectangle and one upper side panel section 3", 5" in the form of a trapezoid.

The top panel 4 comprises spaced-apart handle openings 7, 8 provided symmetrically with its longitudinal center line, on the opposite inner edges of which fold-down handle reinforcing tabs 9, 10 are formed.

Fold lines 11, 11' and 12, 12' extend from the outer edges of the handle openings 7 and 8 more or less diagonally to the edges of the top panel 4.

Weakening lines 13, 13' formed as perforation lines and spaced apart from each other also extend from the outer edge areas of the handle openings 7, 8 to the adjacent longitudinal edges, with said attenuation lines including an acute angle to the transverse center line of the top panel 4. From the longitudinal edges the weakening lines in the areas 13", 13'" and 14", 14'" each extend into the side panels 3, 5 in parallel, with the adjacent weakening lines each being connected to one another at their ends in the upper area of the side panel sections 3', 5' by transversely extending weakening lines $\mathbf{13}^{IV}$, $\mathbf{14}^{IV}$.

Thus, the handle opening 7 and the weakening lines 13 to $\mathbf{13}^{IV}$ as well as the handle opening 8 and the weakening lines 14 to $\mathbf{14}^{IV}$ each define tear tabs 15, 16.

Bottom panel front end straps 17, 17' are hingedly joined to the two transverse edges of the bottom panel 2. The transverse edges of the lower side panel sections 3', 5' comprise lower side panel front end straps 18, 18' and 19, 19' hingedly joined to said transverse edges. To the transverse edge of the upper side panel sections 3", 5" upper side panel front end straps 20, 20' and 21, 21' are hingedly attached.

Finally, top panel front end straps 22, 22' are hingedly joined to the two transverse edges of the top panel 4.

The front end straps 17, 17', 18, 18', 19, 19' and 22, 22' (substantially) are of a rectangular shape. The front end straps 20, 20', 21, 21', substantially, are trapezoidal.

The blank 1 is die-cut from a kraftboard having a grammage of 295 g/m$^2$ .

Figure 2:
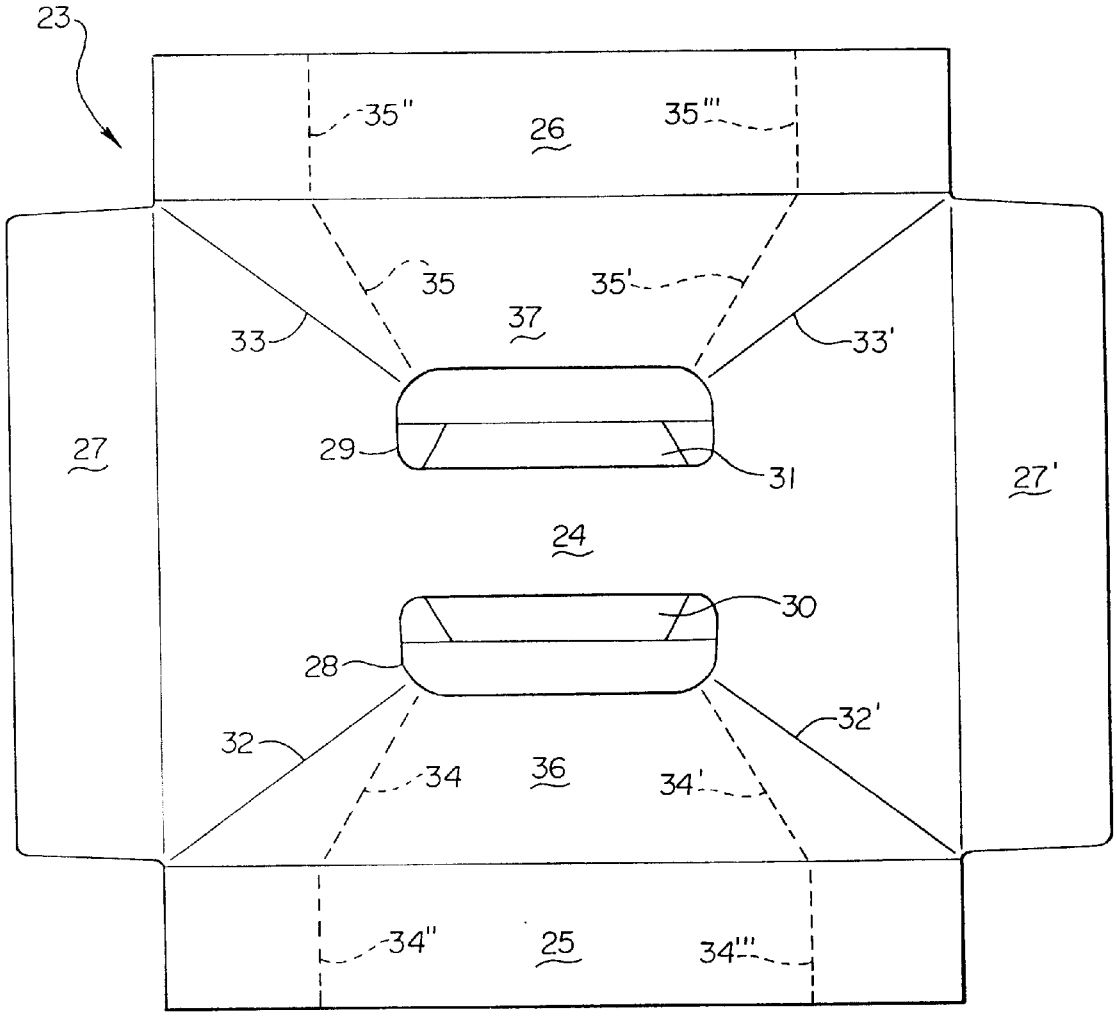
FIG. 2 is an enlarged plan bottom view of the other blank to be arranged above the plurality of bottles.

According to FIG. 2, another blank 23 includes a reinforcement panel 24 which comprises longitudinal straps 25, 26 hingedly attached to the two longitudinal edges and transverse straps 27, 27' hingedly joined to the transverse edges.

The reinforcement panel 24 and the longitudinal straps 25, 26 as well as the transverse straps 27, 27', substantially, are of a rectangular shape. The dimensions of the reinforcement panel 24 are more or less equivalent to those of the top panel 4. The transverse dimensions of the longitudinal straps are only about half as large as those of the upper side panel sections 3", 5". The longitudinal dimensions of the transverse straps 27, 27' are approximately ⅓ of the longitudinal dimensions of the top panel front end straps 22, 22'.

In the reinforcement panel 24 additional handle openings 28, 29 are formed which with handle reinforcing tabs 30, 31 are equivalent to the handle openings 7, 8 of the top panel 4 with respect to location, size and design. Said reinforcement panel 24 comprises fold lines 32, 32' and 33, 33' which extend from the outer edge areas of the handle openings 28, 29 to the edges and which are equivalent to those of the top panel 4 as well. Weakening lines 34, 34' and 35, 35' extend from the outer edge areas of the handle openings 28, 29 to the longitudinal edges, with said weakening lines being at an acute angle to the transverse center line, which is also in conformity with the top panel 4. From there, parallel weakening lines 34", 34'" and 35", 35'" each extend across the longitudinal straps 25, 26.

The handle opening 28 and the weakening lines 34 to 34'" as well as the handle opening 29 and the weakening lines 35 to 35'" each define tear tabs 36, 37.

Figure 3:
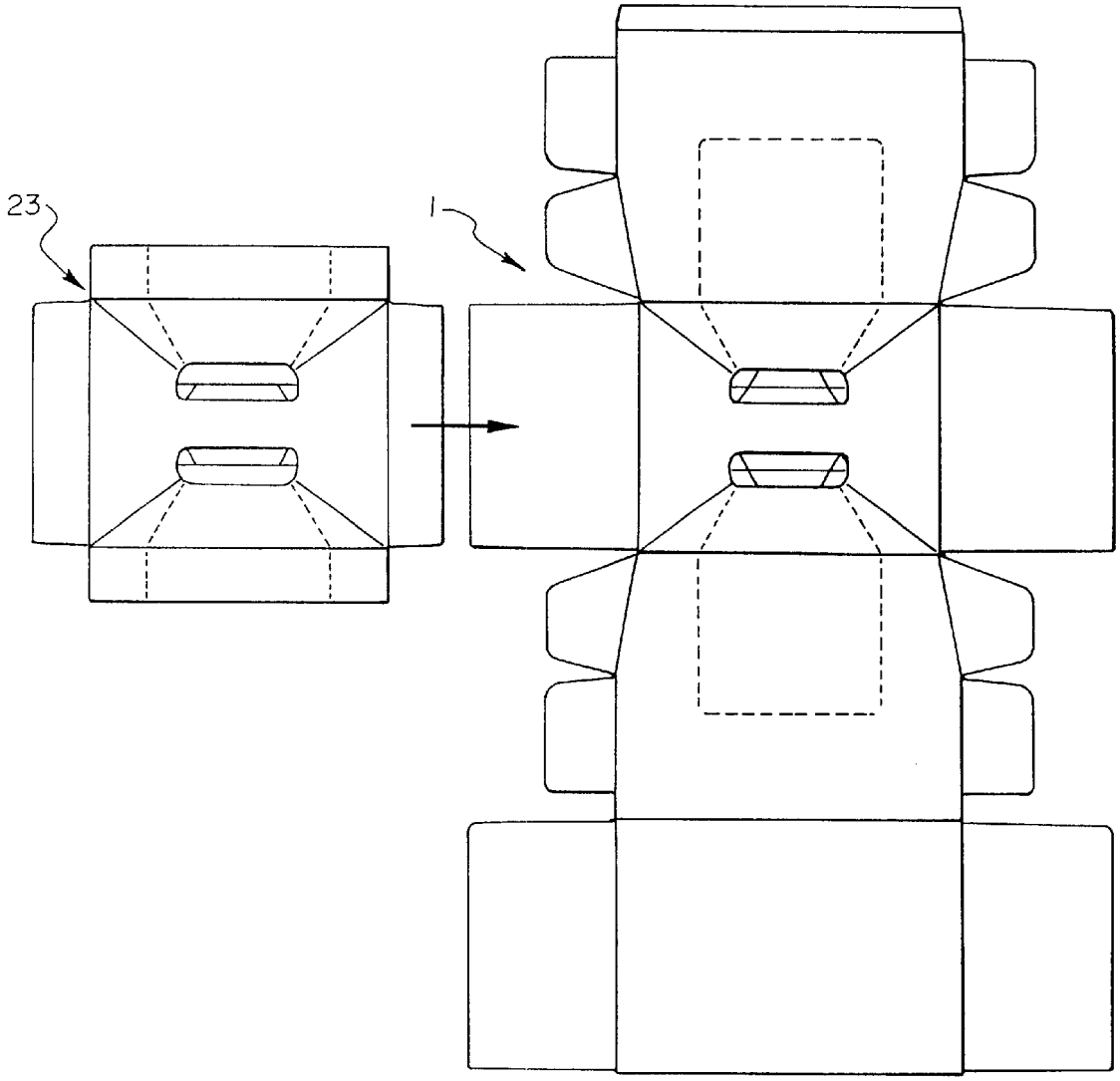
FIG. 3 is a reduced plan bottom view of the blank while being provided with said other blank.

According to FIG. 3, another blank 23 in the flat can be moved onto the inner surface of a blank 1 in the flat in the direction of arrow.

Figure 4:
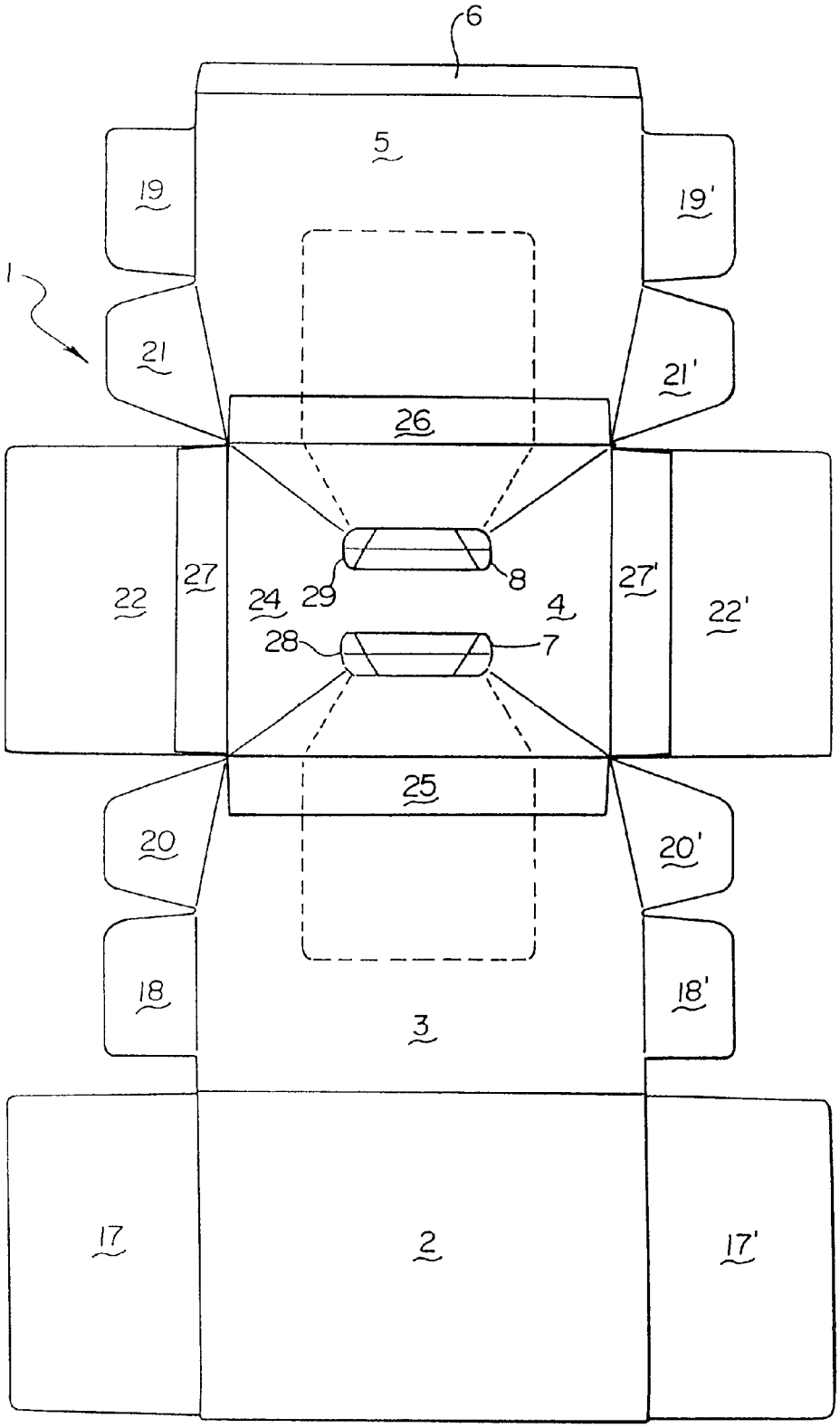
FIG. 4 is a plan bottom view of the blank provided with said other blank.

FIG. 4 illustrates the other blank 23 in its final position on blank 1. In this position, the reinforcement panel 24 is congruently arranged under the top wall 4 so that the longitudinal and transverse edges of both these panels are congruent with one another. Moreover, the additional handle openings 28, 29 are positioned exactly under the handle openings 7, 8, the fold lines 32, 32', 33, 33' are positioned exactly under the fold lines 11, 11', 12, 12' and the weakening lines 34, 34', 35, 35' are positioned exactly under the weakening lines 13, 13', 14, 14'.

Besides, the longitudinal straps 25, 26 cover the upper edge areas of the side panels 3, 5 and the transverse straps 27, 27' cover the upper edge areas of the top panel front end straps 22, 22'. In this position, the weakening lines 34", 34'", 35", 35'" of the longitudinal straps 25, 26 are congruent with the weakening lines 13", 13'" and 14", 14'" of the side panels 3, 5 area by area.

The blank 23 is connected to the blank 1 by glueing. There may be a glueing between the reinforcement panel 24 and the top panel 4 and/or the longitudinal straps 25, 26 and the side panels 3, 5 and/or the transverse straps 27, 27' and the top panel front end straps 22, 22'. A glueing of the longitudinal straps 25, 26 to the side panels 3, 5 is of particular advantage.

This bottle carrier 1, 23 may be pre-manufactured by folding the side panel 5 to the inner surface of the reinforcement panel 24 and folding the bottom panel 2 to the outer surface of the adhesive tab 6 and adhesively glueing them together edge-sided. In this way, the premanufactured carrier can be advantageously stored and transported in the flat one upon the other.

For filling it, it only needs to be unfolded by pressing together the outer longitudinal edge. The carrier then can be filled through the front end openings between the bottom panel 2, the side panels 3, 5 and the top panel 4 or reinforcement panel 24, respectively. According to this embodiment, 12 bottles are inserted which are arranged in three rows.

The side panel front end straps 18, 18' bis 21, 21' then are folded into the front end openings. Thereafter, the bottom panel front end straps 17, 17' are folded to the lower side panel front end straps 18, 18', 19, 19' and are adhesively glued together. Finally, the top panel front end straps 22, 22' are moved towards the upper side panel front end straps 20, 20', 21, 21' and the upper edge of the bottom panel front end straps 17, 17' and are adhesively glued together. The bottle package is ready then.

A user can put one hand through the handle openings 7, 8, 28, 29 by moving the handle reinforcing tabs 9, 10, 30, 31 inwardly and can hold the container carrier by means of the handle portion therebetween then. Moving the handle reinforcing tabs 9, 10, 30, 31 inwardly and putting the hand round the handle portion between handle openings 7, 8, 28, 29 is facilitated by the fact that a middle row of bottles is arranged on the longitudinal center line of the carrier and the top panel 4 and the reinforcement panel 24 in the handle area slightly move away from the heads of the bottles. In spite of this deformation, the construction is not destroyed since the reinforcement panel 24 absorbs forces and causes them to escape into the side panels 3, 5 and front end straps 22,22' and the fold lines 11 bis 12' and 32 to 33' cause forces to escape into the high strength edge areas of the carrier for containers.

The carrier can be opened by tearing out at least one tear tab 15, 36, 16, 37, with the tearing out starting at the handle openings 7, 28 or 8, 29. The bottles then can be successively removed through the exposed opening and the user can keep on holding the carrier by reaching under the handle portion of the same.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A container carrier made from a blank (1) and a further blank (23), comprising:

a blank (1) of a foldable sheet material, for wrapping around a plurality of bottles or other containers, the blank (1) includes a bottom panel (2);

side panels (3, 5) hingedly joined to the longitudinal edges of the bottom panel (2), side panel (5) being joined to bottom panel (2) by adhesive tab (6), hingedly attached to panel (5);

a top panel (4) hingedly joined to other longitudinal edges of the side panels (3, 5);

two spaced-apart handle openings (7, 8) in the top panel (4);

a further blank (23) made of a foldable sheet material, to be arranged above the plurality of containers, the further blank (23) comprises a reinforcement panel (24) provided under the top panel (4);

two further spaced-apart handle openings (28, 29) in the reinforcement panel (24) arranged under the handle openings (7, 8) of the top panel (4), and a connection to the blank (1) to be wrapped around the containers.

2. The container carrier according to claim 1, further including front end openings after side panel (5) is joined to bottom panel (2), the front end openings formed between the bottom panel (2), side panels (3, 5) and top panel (4) of the blank (1), the front end openings being at least partially closed by front end panels (17 to 22, 17' to 22') which are connected to the blank (1).

3. The container carrier according to claim 2, wherein the front end panels further comprises front end straps (17 to 22, 17' to 22') hingedly joined to the transverse edges of the bottom panel (2), side panels (3, 5) and/or top panel (4), moved into the front end openings and connected to one another.

4. The container carrier according to claim 1, wherein the reinforcement panel (23), is defined so as to be congruent with the top panel (4).

5. The container carrier according to claim 1, wherein the reinforcement panel (24) comprises longitudinal straps (25, 26) which are hingedly joined to the longitudinal edges and are lapping over the inner surfaces of the side panels (3, 5).

6. The container carrier according to claim 1, wherein the reinforcement panel (24) comprises transverse straps (27, 27') which are hingedly joined to the transverse edges and are lapping over the inner surfaces of adjacent front end panels (22, 22').

7. The container carrier according to claim 5, wherein the longitudinal straps (25, 26) are connected to the adjacent side panels (3, 5) and/or front end panels (22, 22').

8. The container carrier according to claim 1, wherein the handle openings (7, 8, 28, 29) in the top panel (4) and in the reinforcement panel (24) are spaced apart from one another in transverse direction.

9. The container carrier according to claim 1, wherein fold lines (11 to 12') extend from the outer areas of the handle openings (7, 8) in the top panel (4) to adjacent edges of the top panel (4).

10. The container carrier according to claim 1, wherein two spaced-apart weakening lines (13, 14, 34, 35) each extend, substantially in transverse direction, from the outer areas of the handle openings (7, 8, 28, 29) of the top panel (4) and/or the reinforcement panel (24) to the longitudinal edges, from where they extend into the side panels (3, 5), and are connected to each other by a transversely extending weakening line to form tear tabs (15, 16, 36, 37) defined by the handle openings (7, 8, 28, 29) and the weakening lines (13, 14, 34, 35).

11. The container carrier according to claim 1, wherein the handle openings (7, 8, 28, 29) of the top panel (4) and/or the reinforcement panel (24) comprise handle reinforcing tabs (9, 10, 30, 31) hingedly joined to the inner edges.

12. The container carrier according to claim 1, wherein part or all of the connections are bondings.

13. The container carrier according to claim 1, wherein the wraparound blank (1) is made of a kraftboard.

14. The container carrier according to claim 13, wherein the wraparound blank (1) has a grammage of less than 550 $g/m^2$ .

15. The container carrier according to claim 1, wherein the further blank (23) is made of a recycled board.

16. The container carrier according to claim 1, wherein the further blank (23) is made of an uncoated cardboard material.

17. The container carrier of claim 1 wherein the blank (1) and the further blank (23) are made of cardboard.

18. The container carrier according to claim 14, wherein the wraparound blank (1) has a grammage of less than 400 $g/m^2$.

19. The container carrier according to claim 14, wherein the wraparound blank (1) has a grammage of less than 295 $g/m^2$.

20. The container carrier according to claim 1, wherein fold lines (32 to 33') extend from the outer areas of the handle openings (28, 29) in the reinforcement panel (24) to adjacent edges of the reinforcement panel (24).

21. The container carrier according to claim 1, wherein two spaced-apart weakening lines (13, 14, 34, 35) each extend, substantially in transverse direction, from the outer areas of the handle openings (7, 8, 28, 29) of the top panel (4) and/or the reinforcement panel (24) to the longitudinal edges, from where they extend into and the longitudinal straps (25, 26), and are connected to each other by a transversely extending weakening line to form tear tabs (15, 16, 36, 37) defined by the handle openings (7, 8, 28, 29) and the weakening lines (13, 14, 34, 35).

* * * * *